US006904762B2

(12) United States Patent
Schwartz et al.

(10) Patent No.: US 6,904,762 B2
(45) Date of Patent: Jun. 14, 2005

(54) PUMP PRESSURE LIMITING METHOD

(75) Inventors: William Schwartz, Pleasant Ridge, MI (US); Mukesh Kumar, Canton, MI (US); Gene Cox, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 58 days.

(21) Appl. No.: 10/685,197

(22) Filed: Oct. 14, 2003

(65) Prior Publication Data

US 2005/0103033 A1 May 19, 2005

(51) Int. Cl.[7] ..... F25B 1/00

(52) U.S. Cl. ..... 62/228.3; 62/228.1; 123/41.44; 123/41.19; 417/279; 417/366

(58) Field of Search ..... 62/228.3, 228.1; 123/41.44, 41.19, 41.58, 41.02; 417/239, 417/366

(56) References Cited

U.S. PATENT DOCUMENTS 4,567,858 A 2/1986 Hayashi
4,768,484 A 9/1988 Scarselletta
5,619,957 A 4/1997 Michels
5,845,612 A 12/1998 Lakerdas et al.
6,016,774 A 1/2000 Bokkers et al.
6,314,920 B1 11/2001 Suzuki et al.
6,352,055 B1 3/2002 Algrain et al.
6,477,989 B2 11/2002 Suzuki et al.

*Primary Examiner*—Chen Wen Jiang
(74) *Attorney, Agent, or Firm*—Tung & Associates; Carlos L. Manze

(57) ABSTRACT

A novel pump pressure limiting method for preventing coolant in a cooling system from reaching pressures that exceed predetermined system coolant pressure limits. The method includes reducing the system coolant pressure, as needed to prevent system over-pressurization, by reducing the operational speed of a coolant pump used to pump the coolant through the system. In one embodiment, the system coolant pressure is determined directly, by measurement of the pressure of the coolant in the system typically using pressure sensors. The operational speed of the coolant pump is then reduced until the system coolant pressure decreases to within the predetermined pressure limits. In another embodiment, the system pressure is determined indirectly, by obtaining pressure-indicating data such as coolant temperature. The coolant system pressure is then correlated with the coolant temperature or other data and then the operational speed of the coolant pump is reduced accordingly.

15 Claims, 2 Drawing Sheets

PUMP PRESSURE LIMITING METHOD

FIELD OF THE INVENTION

The present invention generally relates to coolant systems which utilize a pump to circulate coolant through a system and in which system resistance to coolant flow varies over the operating range of the system. More particularly, the invention relates to a pump pressure limiting method which includes reducing the operating speed of the system's coolant pump to maintain coolant pressure within predetermined limits.

BACKGROUND OF THE INVENTION

Fuel cell technology has been identified as a potential alternative for the traditional internal-combustion engine conventionally used to power automobiles. It has been found that fuel cell power plants are capable of achieving efficiencies as high as 55%, as compared to a maximum efficiency of about 30% for internal combustion engines. Furthermore, fuel cell power plants produce no hydrocarbon emissions.

Fuel cells, generally, include three components: a cathode, an anode and an electrolyte which is sandwiched between the cathode and the anode. Oxygen from the air is reduced at the cathode and is converted to negatively-charged oxygen ions. These ions travel through the electrolyte to the anode, where they react with a fuel such as hydrogen. The fuel is oxidized by the oxygen ions and releases electrons to an external circuit, thereby producing electricity which drives an electric motor that powers the automobile. The electrons then travel to the cathode, where they release oxygen from air, thus continuing the electricity-generating cycle. Individual fuel cells can be stacked together in series to generate increasingly larger quantities of electricity.

While a promising alternative in automotive technology, fuel cells are characterized by a low operating temperature which presents a significant design challenge. Maintaining the fuel cell stack within the temperature ranges that are required for optimum fuel cell operation depends on a highly-efficient cooling system which is suitable for the purpose.

Cooling systems for both the conventional internal combustion engine and the fuel cell system typically utilize a pump or pumps to circulate a coolant liquid through a network that is disposed in sufficient proximity to the system components to enable thermal exchange between the network and the components. Such cooling systems are usually subject to imposed coolant pressure limits which are based on component or system durability concerns. Because of various factors such as system design constraints and coolant temperature, many of these cooling systems exhibit significant variations or fluctuations in system resistance to coolant flow during the course of normal system operation. Thus, these systems are particularly vulnerable to producing coolant pressures which exceed the coolant pressure limits for the systems. The fuel cell cooling system has been found to manifest a particularly wide variation in coolant pressures over the normal operating range of the system.

Without the use of controls to reduce coolant pressure in a cooling system as needed for maintaining the coolant pressure within the imposed coolant pressure limits, the durability and operational integrity of the system or of system components may be compromised, requiring inordinately frequent system maintenance, repair and/or replacement. Because coolant systems for both fuel cell systems and conventional internal combustion engines lack a mechanism for measuring and controlling coolant system pressures, there is an established need for a method which is effective in controlling the pressures of coolant in a cooling system to prevent coolant pressures from exceeding pressure limitations for the system.

SUMMARY OF THE INVENTION

The present invention is generally directed to a novel pump pressure limiting method for preventing coolant in a cooling system from reaching pressures that exceed predetermined system coolant pressure limits. The method includes reducing the system coolant pressure, as needed to prevent system over-pressurization, by reducing the operational speed of a coolant pump used to pump the coolant through the system. In one embodiment, the system coolant pressure is determined directly, by measurement of the pressure of the coolant in the system typically using pressure sensors. The operational speed of the coolant pump is then reduced until the system coolant pressure decreases to within the predetermined pressure limits. In another embodiment, the system pressure is determined indirectly, by obtaining pressure-indicating data such as coolant temperature. The coolant system pressure is then correlated with the coolant temperature or other data and then the operational speed of the coolant pump is reduced accordingly.

BRIEF DESCRIPTION OF THE DRAWINGS

The invention will now be described, by way of example, with reference to the accompanying drawing, in which.

DETAILED DESCRIPTION OF THE INVENTION

The present invention is generally directed to a novel pump pressure limiting method for preventing over-pressurization of coolant in a cooling system in which system resistance to coolant flow, and thus, system coolant pressure, varies across the normal operating range of the system. Such a system is designed to operate within imposed coolant pressure limit specifications beyond which the structural or operational integrity of the system or system components would otherwise be compromised. The system resistance to coolant flow may be a function of system design characteristics, such as structural features, or of properties of the coolant liquid, such as coolant temperature, or a combination of factors. In any case, the operational speed of the pump may be reduced according to the method of the present invention to either decrease the excessive system coolant pressure back to within the predetermined pressure limit specifications for the system or prevent over-pressurization of the coolant beyond the pressure limit specifications. In one embodiment of the invention, a direct measurement of the pressure of the coolant in the system is used to reduce the operational speed of the coolant pump and prevent system over-pressurization when the measured pressure reaches or exceeds the predetermined upper pressure limit. In another embodiment, an indirect measurement of the pressure in the system is made based on parameters such as coolant temperature and pump speed, and the operational speed of the coolant pump is reduced accordingly to prevent system over-pressurization, as needed.

Because coolant pressure in a cooling system usually increases with pump speed, limiting pump speed in potential cooling system over-pressure situations is a viable way to control the coolant pressure in such systems. In cooling systems in which coolant pressures are directly measured by the use of pressure sensors, the pump speed can simply be decreased when the measured coolant pressures reach their limits. However, in many cooling systems, such as automotive cooling systems, coolant pressures are not measured. In these types of systems, other methods are needed to indirectly assess coolant pressures such that coolant pump speeds can be controlled in order to maintain coolant pressures below their upper limits. Cooling systems which exhibit a significant change in system resistance to coolant flow in the normal range of operations are particularly vulnerable to having operating ranges in which pressure limits are exceeded. Fuel cell cooling systems serve as one example of cooling systems the resistance of which changes dramatically over the normal operating range of the system. As a result, fuel cell cooling systems can have relatively large operating ranges in which coolant pressures exceed the pressure limitations of the system.

Figure 1:
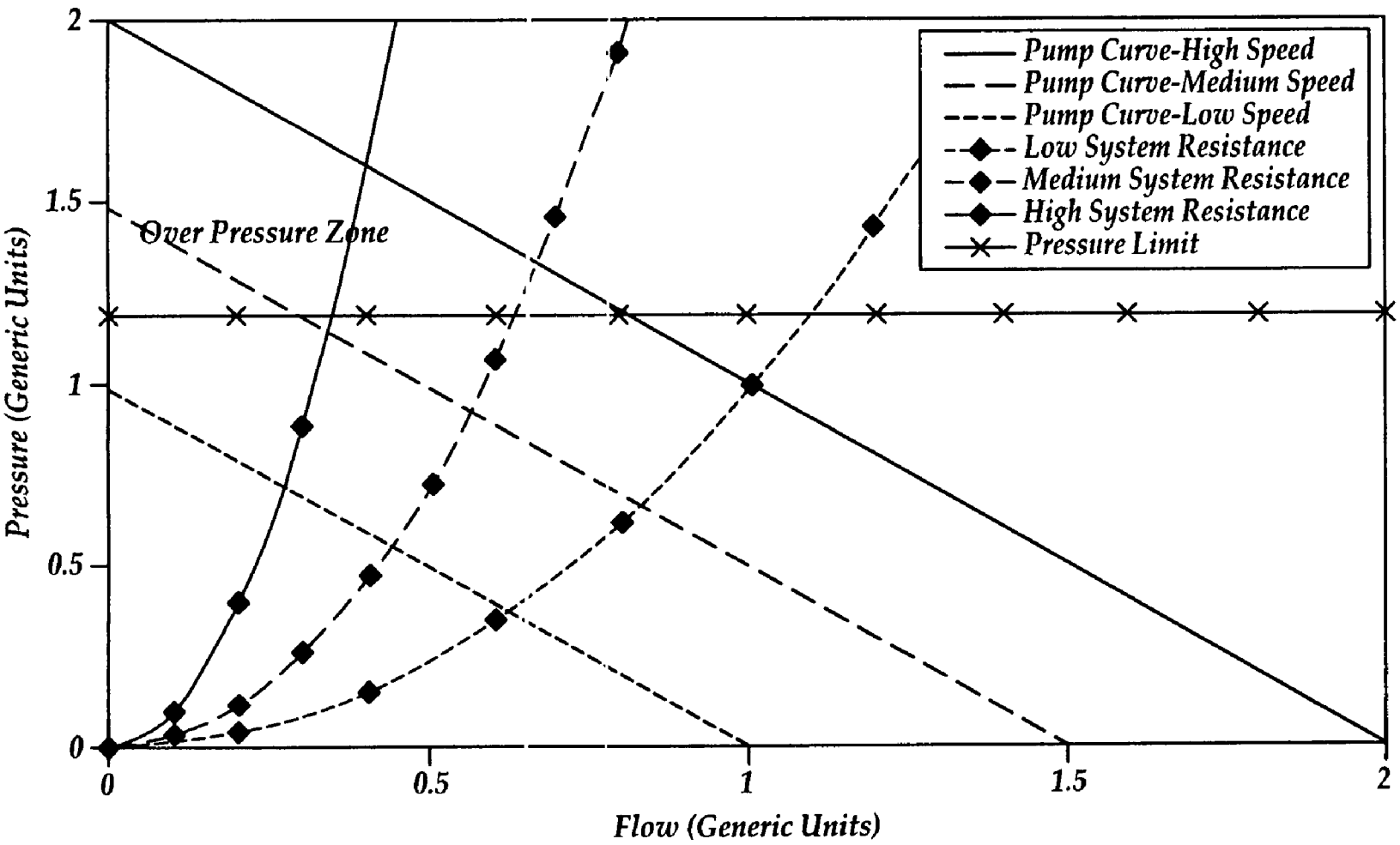
FIG. 1 is a graph illustrating the relationships between pump speed, system resistance, system coolant pressure and coolant flow rate in a cooling system.
Figure 4:
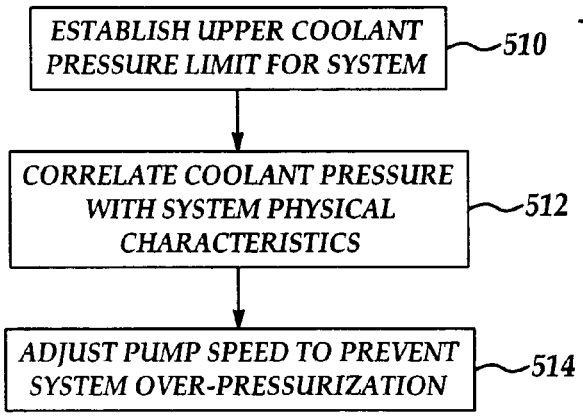
FIG. 4 is a flow diagram illustrating sequential steps according to a third embodiment of the pump pressure limiting method of the present invention.

Referring initially to FIG. 1, three pump speed curves (straight sloped lines) represent the coolant pressure vs. flow characteristics generated by the same coolant pump in a cooling system at three different pump speeds, respectively. Three system resistance curves (curved sloped lines) represent the coolant pressure vs. flow characteristics of the cooling system, in which the coolant pump is subjected to three different resistance levels, respectively, all within the normal operating range of the system. All three system resistance curves indicate that, for a given pump speed, coolant pressure increases as the rate of coolant flow decreases. Such system resistance, manifested by a reduction in the rate of coolant flow, is variable over the operational range of the system and is common in cooling systems in which system resistance is a strong function of coolant temperature, as is the case with regard to fuel cell cooling systems, in particular. In such systems, system resistance to coolant flow is inversely proportional to coolant temperature. Accordingly, at low coolant temperatures, system resistance and system pressure are high, whereas system resistance and pressure decrease as coolant temperatures rise. The intersection of the pump and resistance curves on the graph of FIG. 4 represents the flow rate and pressure of the coolant at that particular combination of pump speed and system resistance. The space between the low pump speed curve and the high pump speed curve represents a continuum of operational pump speeds, and the space between the low system resistance curve and the high system resistance curve represents a continuum of system resistances. The horizontal pressure limit line in FIG. 1 represents the upper operational limit of coolant pressure imposed on the system.

In FIG. 1, the operating range of the cooling system is represented by all the combinations of system resistance and pump speed curve intersection points which are possible on the graph. FIG. 1 additionally shows an over-pressure zone in which pressure limits are exceeded in normal system operation due to the characteristics of the system resistance and pump speeds of the system. It can be seen that the medium and high pump speed curves, as well as the medium and high system resistance curves, pass through the over-pressure zone, whereas the low speed pump curve and the low system resistance curve do not. Therefore, operation of the coolant pump at low speeds at all times will never result in a coolant over-pressure situation. However, system flow targets may not allow this operational constraint. Furthermore, although a pump and/or system which avoid the attainment of an over-pressure zone may be designed, this luxury may not always be possible given the system flow targets and the system and pump options available. Thus, it is frequently necessary to vary the pump speed when significant system resistance to coolant flow is encountered, in order to prevent over-pressurization of the cooling system.

Figure 2:
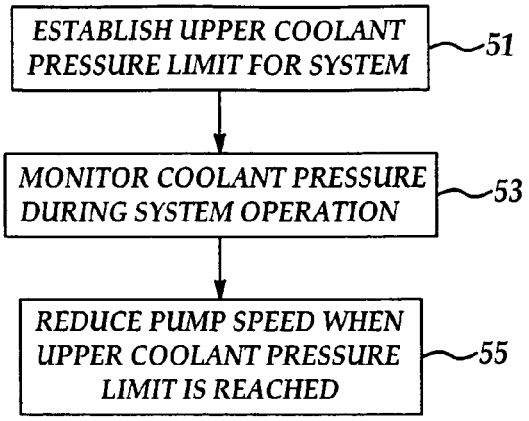
FIG. 2 is a flow diagram illustrating sequential steps according to a first embodiment of the pump pressure limiting method of the present invention.

Referring next to FIG. 2, in accordance with one embodiment of the present invention, if the variability in system resistance to coolant flow is due to any single factor or a variety of factors, the coolant pressure in the system can be directly measured and the operational speed of the cooling pump reduced accordingly to prevent system over-pressurization. Accordingly, an upper coolant pressure limit is established for the cooling system, as indicated in step S1. Typically, the upper coolant pressure limit ranges from about 25 psi to about 50 psi. However, it is understood that the upper coolant pressure limit will vary based on the particular cooling system to be used and is designed to preserve the structural integrity of the cooling system and cooling system components. Throughout normal operation of the cooling system, the coolant pressure of the coolant in the system is continually or periodically monitored, as shown in step S3. This may be accomplished by providing pressure sensors in the cooling system to directly monitor the pressure of the coolant flowing through the system. As indicated in step S5, in the event that the measured coolant pressure rises to or beyond the predetermined upper pressure limit, the operational speed of the coolant pump in the system is reduced accordingly, to decrease the coolant pressure back to a level which is lower than the upper pressure limit established for the coolant in the cooling system. The method may further include the steps of establishing a lower pressure limit for the coolant in the cooling system; monitoring the coolant pressure; and increasing the operational speed of the coolant pump, as needed, to increase the coolant pressure back to a level which is higher than the lower pressure limit established for the coolant.

Figure 3:
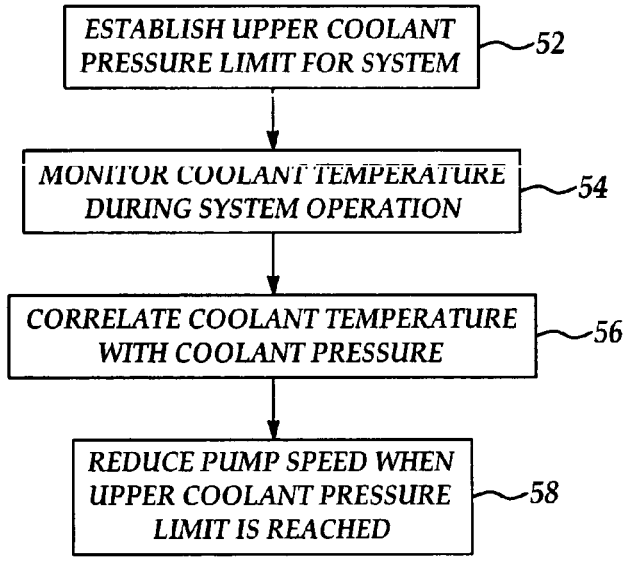
FIG. 3 is a flow diagram illustrating sequential steps according to a second embodiment of the pump pressure limiting method of the present invention.

Referring next to FIG. 3, in accordance with another embodiment of the present invention, if the variability in system resistance to coolant flow is due at least in part to variations in temperature of the coolant in the system, this variability in system resistance as a function of coolant temperature and pump speed is used to adjust the operational speed of the coolant pump to prevent system over-pressurization, as needed. Accordingly, an upper coolant pressure limit is established for the cooling system, as indicated in step S2. Throughout normal operation of the cooling system, the temperature of the coolant in the system is continually or periodically measured. As indicated in step S6, the measured temperature value is correlated with the operating resistance of the system to coolant flow for particular coolant pump speeds. In the event that a relatively low coolant temperature is correlated with an operating resistance which results in over-pressurization of the cooling system at a particular pump operational speed, the operational speed of the coolant pump is reduced accordingly to avoid operating the cooling system in the over-pressure zone, as indicated in step S8. Thus, the maximum pump speed is limited based on the temperature of the coolant and pump speed in such a manner that an over-pressure situation is avoided. When coolant temperatures rise, the operational speed of the coolant pump is increased accordingly, since higher coolant temperatures are correlated with lower system resistance to the coolant, and thus, lower system pressures. In FIG. 1, it can be seen that when the system resistance is sufficiently low (corresponding to a higher coolant temperature), the coolant pump can be operated at maximum speed without realizing an over-pressure situation. This illustrates that the pump speed may not need to be limited at all in some regions of the system's operating range. The method may further include the steps of establishing a lower pressure limit for the coolant in the cooling system; monitoring the coolant temperature during system operation; correlating the coolant temperature and pump speed with coolant pressure; and increasing the operational speed of the coolant pump, as needed, to increase the coolant pressure back to a level which is higher than the lower limit established for the coolant.

In some cooling systems, factors such as coolant system loops of various structural characteristics or temperature-independent characteristics of the coolant can induce dramatic variability in the system resistance characteristics. The system resistance characterization in these applications may reveal that pump speeds need to be limited based on a parameter other than temperature, such as another characteristic of the coolant, which particular coolant system loop or flow circuit is in operation, or whether the system is in transition between loop or circuit options. According to the method of the present invention, this system characterization is then used to indirectly determine pressures of the coolant at various pump operational speeds or is experimentally correlated with pressures of the coolant at various pump operational speeds. Based on these coolant pressures, the operational speed of the coolant pump is controlled to avoid operating the cooling system in the over-pressure zone.

Variations in coolant pressure among different ones of multiple coolant system loops in the same cooling system may result from differences in the structural characteristics among the coolant system loops. Other structural characteristics of the cooling system loop, such as variations in the material of construction among different cooling system loops or segments of the cooling system, may contribute to variations in coolant pressures over the operational range of the system. It is also possible that the system resistance characterization will reveal the necessity to limit pump speed based on multiple factors, one or more of which may include temperature and/or structural characteristics of cooling system loops in the system, for example.

Referring next to FIG. 4, in accordance with yet another embodiment of the present invention, a typical sequence of steps carried out to prevent over-pressurization of a cooling system based on physical characteristics of the system includes establishing an upper coolant pressure limit for the system, as indicated in step S10; experimentally correlating pressures of a coolant flowing through the system at given pump speeds with one or more physical characteristics of the system, as indicated in step S12; and adjusting the operational speed of the coolant pump to prevent over-pressurization of the coolant beyond the upper coolant pressure limit.

While the preferred embodiments of the invention have been described above, it will be recognized and understood that various modifications can be made in the invention and the appended claims are intended to cover all such modifications which may fall within the spirit and scope of the invention.

What is claimed is:

1. A method of limiting a pressure of a coolant in a cooling system having a coolant pump, comprising the steps of:

providing an upper pressure limit for the coolant;

determining the pressure of the coolant in the cooling system; and reducing an operating speed of the coolant pump when the pressure of the coolant reaches said upper pressure limit.

2. The method of claim 1 wherein said determining the pressure of the coolant in the cooling system comprises obtaining an indirect measurement of the pressure of the coolant.

3. The method of claim 2 wherein said obtaining an indirect measurement of the pressure of the coolant comprises determining the pressure of the coolant based on a temperature of the coolant and the pump speed.

4. The method of claim 2 wherein said obtaining an indirect measurement of the pressure of the coolant comprises determining the pressure of the coolant based on a structural characteristic of the cooling system.

5. The method of claim 4 wherein said obtaining an indirect measurement of the pressure of the coolant further comprises determining the pressure of the coolant based on a temperature of the coolant.

6. The method of claim 1 wherein said upper pressure limit is from about 25 psi to about 50 psi.

7. The method of claim 6 wherein said determining the pressure of the coolant in the cooling system comprises obtaining an indirect measurement of the pressure of the coolant.

8. The method of claim 7 wherein said obtaining an indirect measurement of the pressure of the coolant comprises determining the pressure of the coolant based on a temperature of the coolant and the pump speed.

9. The method of claim 7 wherein said obtaining an indirect measurement of the pressure of the coolant comprises determining the pressure of the coolant based on a structural characteristic of the cooling system.

10. The method of claim 9 wherein said obtaining an indirect measurement of the pressure of the coolant further comprises determining the pressure of the coolant based on a temperature of the coolant and pump speed.

11. A method of limiting a pressure of a coolant in a cooling system having a coolant pump, comprising the steps of:

providing an upper pressure limit for the coolant;

obtaining a direct measurement of the pressure of the coolant in the cooling system; and reducing an operating speed of the pump when the pressure of the coolant reaches said upper pressure limit.

12. The method of claim 11 wherein said upper pressure limit is from about 25 psi to about 50 psi.

13. A method of limiting a pressure of a coolant in a cooling system having a coolant pump, comprising the steps of:

providing an upper pressure limit for the coolant;

measuring a temperature of the coolant in the cooling system;

correlating the temperature of the coolant with the pressure of the coolant; and reducing an operating speed of the pump when the pressure of the coolant reaches said upper pressure limit.

14. The method of claim 13 further comprising the step of determining the pressure of the coolant based on a structural characteristic of the cooling system.

15. The method of claim 13 wherein said upper pressure limit is from about 25 psi to about 50 psi.

* * * * *